United States Patent [19]

Kaneko et al.

[11] Patent Number: 5,003,891

[45] Date of Patent: Apr. 2, 1991

[54] PULVERIZED COAL COMBUSTION METHOD

[75] Inventors: Shozo Kaneko; Masaaki Kinoshita, both of Nagasaki, Japan

[73] Assignee: Mitsubishi Jukogyo Kabushiki Kaisha, Tokyo, Japan

[21] Appl. No.: 485,087

[22] Filed: Feb. 26, 1990

[30] Foreign Application Priority Data

Mar. 3, 1989 [JP] Japan ..... 1-49874

[51] Int. Cl.[5] ..... F23B 7/00; F23D 1/02

[52] U.S. Cl. ..... 110/341; 110/347; 110/264; 122/4 D

[58] Field of Search ..... 110/106, 245, 347, 341; 122/4 D

[56] References Cited

U.S. PATENT DOCUMENTS

| | | | |
|---|---|---|---|
| 4,501,204 | 2/1985 | McCantney et al. | 110/264 |
| 4,672,900 | 6/1987 | Santalla et al. | 110/264 |
| 4,773,339 | 9/1988 | Garcia-Mallol | 122/4 D |

*Primary Examiner*—Henry C. Yuen

*Attorney, Agent, or Firm*—Wenderoth, Lind & Ponack

[57] ABSTRACT

The known pulverized coal combustion method including the steps of separating pulverized coal mixture gas ejected from a vertical type coal grinder into thick mixture gas and thin mixture gas by a distributor, and injecting these thick and thin mixture gases, respectively, through separate burner injecting ports into a common furnace to make them burn, is improved so as to reduce both an unburnt content in the ash and a nitrogen oxide concentration in exhaust gas while maintaining an excellent ignition characteristic. The improvements reside in that an air-to-fuel ratio of the thick mixture gas is regulated to within the range of 1–2, while an air-to-fuel ratio of the thin mixture gas is regulated to within the range of 3–6, and the range of a degree of pulverization of the pulverized coal is regulated to 100 mesh residue 1.5% or less. The degree of pulverization of the pulverized coal fed to the distributor is regulated either by adjusting the rotational speed of a rotary type classifier in the grinder or by adjusting the angles formed between classifying vanes, rotating about the axis of the rotary type classifier, and the direction of rotation.

5 Claims, 11 Drawing Sheets

PULVERIZED COAL COMBUSTION METHOD

BACKGROUND OF THE INVENTION

1. Field of the Invention

The present invention relates to a method for combusting pulverized coal, and more particularly to a method for combusting of pulverized coal including the steps of separating pulverized coal mixture gas ejected from a vertical type coal grinder containing a rotary type classifier therein into thick mixture gas and thin mixture gas by means of a distributor, and injecting these thick and thin mixture gases respectively through separate burner injection ports into a common furnace to make them burn.

2. Description of the Prior Art

One example of the method for combusting pulverized coal in the prior art is shown in a system diagram in FIG. 8. In this figure, reference numeral 01 designates a vertical type coal grinder containing a stationary type classifier therein, numeral 2 designates a pulverized coal pipe, numeral 3 designates a distributor, numeral 4 designates a thick mixture gas feed pipe, numeral 5 designates a thin mixture gas feed pipe, numeral 6 designates a thick mixture gas burner, numeral 7 designates a thin mixture gas feed pipe, numeral 8 designates a boiler furnace.

Pulverized coal mixture gas consisting of coal pulverized finely by the vertical type coal grinder 01 and primary air for combustion is, after having been ejected from the coal grinder and introduced into the pulverized coal pipe 2, separated into thick mixture gas and thin mixture gas by the distributor 3. The thick mixture gas passes through the thick mixture gas feed pipe 4 and is injected from the thick mixture gas burner 6 into the boiler furnace 8 to burn. On the other hand, the thin mixture gas passes through the thin mixture gas feed pipe 5 and is injected from the thin mixture gas burner 7 into the boiler furnace 8 to burn. In such a pulverized coal combustion method in the prior art, by separating pulverized coal mixture gas into thick mixture gas and thin mixture gas and making them burn separately, a suppression of the production of nitrogen oxides ($NO_x$) in the course of the combustion reaction is effected, and, therefore, in recent low $NO_x$ combustion apparatuses, such a method is most frequently employed.

One example of a vertical type coal grinder 01 containing a stationary type classifier is shown in a longitudinal cross-sectional view of FIG. 9. In this figure, material to be ground such as lumped powder coal or the like charged through a feed pipe 10 is subject to a load, on a rotary table 20 by a grinding roller 30 and is thus ground into pulverized coal, and is spattered towards the outer circumference of the same rotary table 20. On the other hand, hot air is issued from a hot air inlet port 40 at the lower portion of the coal grinder 01 through a blow-up portion 50 into a mill. The above-mentioned pulverized coal spattered towards the outer circumference of the rotary table 20 is blown to the upper portion of the coal grinder 01 by this hot air, that is, by this carrier gas, passes through stationary vanes 80 and is fed into a stationary type classifier 60, where it is separated into fine powder and coarse powder. Then the fine powder is taken out through a pulverized coal pipe 110, while the coarse powder falls along the inner circumferential wall of the stationary type classifier 60 onto the rotary table 20 and is ground again.

In the above-described pulverized coal combustion method in the prior art, in order to reduce the amount of unburnt material in ash in the boiler constituting loss, it is desirable to make the degree of pulverized coal to be burnt as fine as possible. However, if the degree of pulverization is made excessively high, a degradation of the capability of the grinder and an increase of power consumption would become remarkable. And, moreover, problems such as the generation of vibrations would arise. Therefore, in the pulverized coal combustion method making use of a vertical type coal grinder containing a stationary type classifier therein, it is a common practice to operate the machine with a degree of pulverization of 200 mesh pass 80% or less. A general characteristic of a vertical type coal grinder containing a stationary type classifier therein is shown in FIG. 10. As shown in this figure, in the case where pulverization has been effected by the above-mentioned grinder up to a degree of pulverization of about 200 mesh pass 80%, in the pulverized coal are contained coarse particles of 100 mesh or larger by about 2.4%, representing an inevitable phenomenon which is characteristic of a stationary type classifier.

Now, the mixture gas of pulverized coal ground in the above-described manner is separated into thick mixture gas and thin mixture gas by means of a distributor. However, since the distributor utilizes a classifying effect based on inertial forces, it is inevitable that most of the above-mentioned coarse particles of 100 mesh or larger tend to flow to the side of thick mixture gas. One example of the configuration of the above-described distributor is shown in FIG. 11. In this figure, pulverized coal mixture gas introduced into the distributor through a pulverized coal mixture gas inlet 3*a* is separated into thick mixture gas and thin mixture gas due to inertial forces, and the mixture gases are ejected, respectively, through a thick mixture gas outlet 3*b* and a thin mixture gas outlet 3*c*. In the above-mentioned distributor, while coarse particles of 100 mesh or larger are contained by 2.5% in the pulverized coal at the inlet, 95% or more of such particles are ejected through the thick mixture gas outlet 3*b*.

The thick mixture gas burner suppresses production of nitrogen oxides by burning pulverized coal within a low oxygen content atmosphere containing air less than a theoretical combustion air amount. However, in the above-described thick mixture gas there is contained a large amount of coarse particles of 100 mesh or larger. Because these coarse particles cannot fully burn out within the low oxygen content atmosphere, most of such particles remain as an unburnt material in ash. Therefore, an unburnt ash component of the mixture gas is high, resulting in a problem of high loss of efficiency in the boiler. A general relation between a degree of pulverization and an unburnt ash content is shown in FIG. 12.

On the other hand, from a view point of effective utilization of coal, the necessity for suppressing an unburnt ash content to less than a regulated value would often arise. And, in such cases since operations for increasing a surplus air proportion are necessitated, there was a problem in that the production of nitrogen oxides could not be effectively suppressed. Relations between a surplus air proportion and an $NO_x$ content as well as an unburnt ash content in the above-described combustion method in the prior art are shown in FIG. 13.

Furthermore, the dashed line curve of FIG. 7 represents a relation between an unburnt ash content and an $NO_x$ content in the pulverized coal combustion method in the prior art. Among these contents, if one is reduced, then the other tends to increase, and so, in order to reduce both the unburnt ash content and the $NO_x$ content, a novel technique is necessary.

In addition, relations between a concentration ratio of the thick mixture gas to the thin mixture gas and an $NO_x$ content as well as an unburnt ash content are established as shown in FIG. 14. If the concentration ratio is increased, the $NO_x$ content is lowered but the unburnt content is increased. Accordingly, in order to maintain both the $NO_x$ content and the unburnt ash content at proper values, it would be necessary to arbitrarily and automatically control the aforementioned concentration ratio according to variations of a boiler load and the kind of coal employed. However, in the pulverized coal combustion method in the prior art, such control was impossible.

SUMMARY OF THE INVENTION

It is therefore one object of the present invention to provide a novel pulverized coal combustion method that is free from the above-mentioned shortcomings in the prior art.

A more specific object of the present invention is to provide a pulverized coal combustion method in which an unburnt ash content and a concentration of nitrogen oxide in an exhaust gas are both low, and an ignition characteristic is excellent.

According to one feature of the present invention, there is provided a pulverized coal combustion method including the steps of separating pulverized coal mixture gas ejected from a vertical type coal grinder containing a rotary type classifier therein into thick mixture gas and thin mixture gas by means of a distributor, and injecting these thick and thin mixture gases, respectively, through separate burner injection ports into a common furnace to make them burn, improved in that an air-to-fuel ratio of the thick mixture gas is chosen at 1–2, while an air-to-fuel ratio of the thin mixture gas is chosen at 3–6, and the range of a degree of pulverization of the pulverized coal is regulated to 100 mesh residue 1.5% or less.

According to another feature of the present invention, there is provided the above-featured pulverized coal combustion method, wherein the degree of pulverization of the pulverized coal fed to the distributor is regulated by adjusting a rotational speed of the rotary type classifier.

According to still another feature of the present invention, there is provided the first-featured pulverized coal combustion method, wherein the degree of pulverization of the pulverized coal fed to the distributor is regulated by adjusting the angles formed between classifying vanes, rotating about the axis of the rotary type classifier, and the direction of rotation.

An operation characteristic of a vertical type coal grinder containing a rotary type classifier therein is shown in FIG. 5. As shown in this figure, in the case where pulverization has been effected in this coal grinder under the condition of 200 mesh pass 85%, coarse particles of 100 mesh or larger in the pulverized coal are reduced to 0.1%. In combustion within a low oxygen content atmosphere, the possibility of coarse particles of 100 mesh or larger remaining as an unburnt content in ash is high as shown in FIG. 13. On the other hand, in the case where the ash of burnt coal is used as a raw material of cement, generally it is necessary to make an unburnt content in the ash 5% or less. While the amount of unburnt material in the ash is different depending upon the degree of pulverization, the kind of coal and the like, as shown in FIG. 20 by regulating a degree of pulverization at 100 mesh residue 1.5% or less, the unburnt content of the ash can always be 5% or less. Taking the aforementioned fact into consideration, according to the present invention, the range of a degree of pulverization of the pulverized coal is regulated to 100 mesh residue 1.5% or less. Since the amount of coarse particles of 100 mesh or larger can be greatly reduced to as small as 100 mesh residue 1.5% or less by employing the grinding machine containing a rotary type classifier therein, unburnt content constituting efficiency loss in the boiler can be remarkably decreased as compared to the prior art. In addition, in the event that a loss of the same order as that in the prior art is allowed, the machine can be operated at a surplus air proportion in FIG. 13 that is lower in correspondence with the reduction of coarse particles of 100 mesh or larger. Hence, a nitrogen oxide concentration in a boiler exhaust gas can be greatly reduced as compared to that in the prior art.

In addition, by adjusting a rotational speed of a rotary type classifier and angles formed between classifying vanes and the direction of rotation, a degree of pulverization can be arbitrarily and automatically changed. Concentration ratios of the thick and thin mixture gases at the outlet, when pulverized coal having different degrees pulverization has been fed to the distributor shown in FIG. 11, are shown in FIG. 15. In the case where a pulverized particle is small, since a classifying effect into thick and thin mixture gases due to a centrifugal force becomes small, the concentration ratio would become small as shown in this figure. Accordingly, by adjusting a rotational speed of the rotary type classifier and angles formed between classifying vanes and the direction of rotation, an $NO_x$ content and an unburnt ash content can be arbitrarily and automatically regulated.

The above-mentioned and other objects, features and advantages of the present invention will become more apparent by referring to the following description of one preferred embodiment of the invention taken in conjunction with the accompanying drawings.

DETAILED DESCRIPTION OF THE PREFERRED EMBODIMENT

Figure 1:
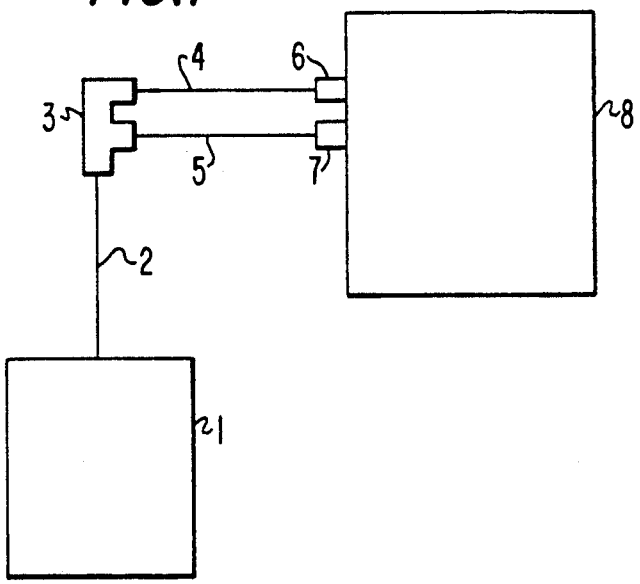
FIG. 1 is a schematic diagram of a system for carrying out one preferred embodiment of a method for combusting coal according to the present invention.

One preferred embodiment of the present invention is illustrated in a system diagram in FIG. 1. In this figure, reference numeral 1 designates a vertical type coal grinder containing a rotary type classifier therein, numeral 2 designates a pulverized coal pipe, numeral 3 designates a distributor, numeral 4 designates a thick mixture gas feed pipe, numeral 5 designates a thin mixture gas feed pipe, numeral 6 designates a thick mixture gas burner, numeral 7 designates a thin mixture gas burner disposed contiguously to the thick mixture gas burner 6, and numeral 8 designates a boiler furnace.

Coal pulverized by the vertical type coal grinder 1 is, after having been ejected from the same coal grinder 1 as pulverized coal mixture gas and introduced into the pulverized coal pipe 2, separated into thick mixture gas and thin mixture gas by means of the distributor 3. The thick mixture gas passes through the thick mixture gas feed pipe 4 and is ejected from the thick mixture gas burner 6 into the boiler furnace 8 to burn. On the other hand, the thin mixture gas passes through the thin mixture gas feed pipe 5 and is ejected from the thin mixture gas burner 7 into the boiler furnace 8 to burn. The above-mentioned operations are similar to those in the pulverized coal combustion method in the prior art.

Figure 2:
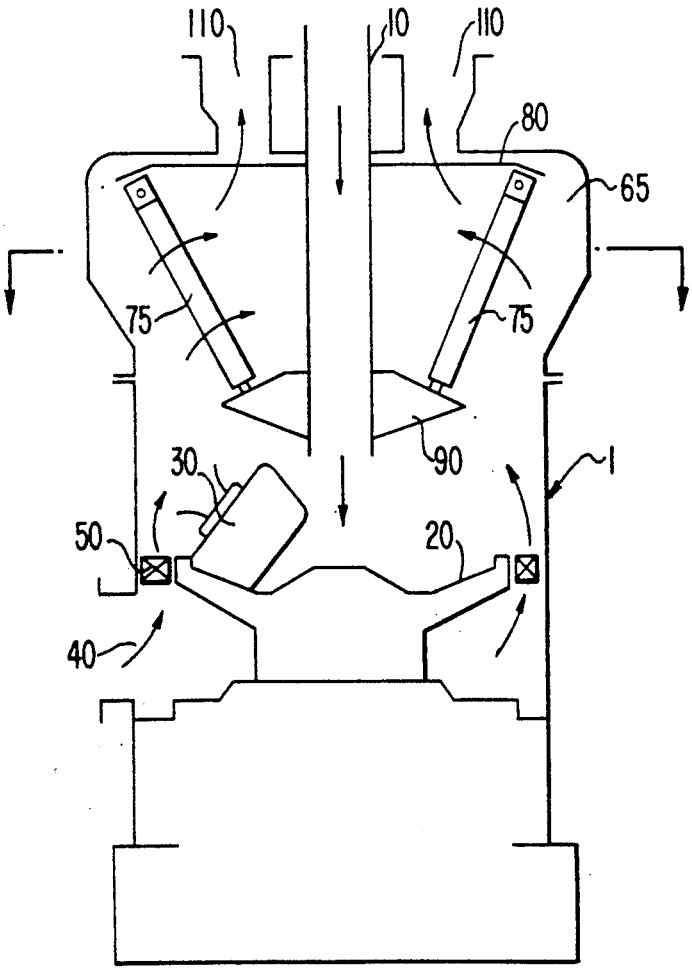
FIG. 2 is a longitudinal cross-sectional view of a vertical type coal grinder containing a rotary type classifier therein, which may be employed in the system of FIG. 1 to carry out the method according to the present invention.
Figure 3:
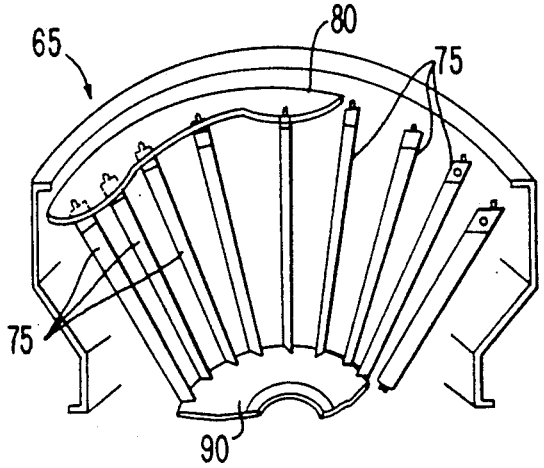
FIG. 3 is a perspective view partly cut away of the same rotary type classifier.
Figure 4:
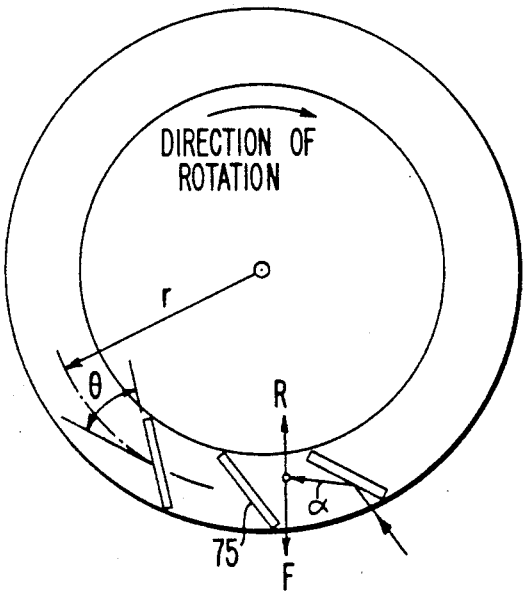
FIG. 4 is a transverse cross-sectional view taken along line IV—IV in FIG. 2.

FIG. 2 is a longitudinal cross-sectional view of the above-mentioned vertical type coal grinder 1 containing a rotary type classifier therein. FIG. 3 is a perspective view partly cut away of the rotary type classifier. And FIG. 4 is a transverse cross-sectional view taken along chain line IV—IV in FIG. 2. At first, with reference to FIGS. 2 and 3, material to be ground such as lumped powder coal charged through a feed pipe 10 is subjected to a load on a rotary table 20 by a grinding roller 30, is thus pulverized into powder, and is spattered towards the outer circumference of the rotary table 20. On the other hand, hot air is sent from a hot air inlet portion 40 at the lower portion of coal grinder 1 through a blow-up portion 50 into the inside of a mill. The above-mentioned pulverized coal spattered towards the outer circumference of the rotary table 20 is carried into a rotary type classifier 65 at the by the hot air, that is, by the carrier gas, and is separated into coarse powder and fine powder. The fine powder is taken out through a pulverized coal pipe 110, while the coarse powder is spattered to the outside and falls so as to be ground again.

In the above-mentioned rotary type classifier 65, a plurality of classifying vanes 75 are disposed so as to extend along generating lines of an inverted frustum of a having a vertical axis, have their upper and lower ends fixedly secured to an upper support plate 80 and a lower support plate 90, respectively, and are constructed so as to be rotated by the feed pipe 10 disposed along the above-mentioned axis, that is, by a vertical drive shaft. The angles $\theta$ formed between the plurality of classifying vanes 75 and the direction of rotation can be changed by an appropriate mechanism not shown. As a result of the rotation of the classifying vanes 75, pulverized coal in a carrier gas is classified into coarse powder and fine powder, and the principle of classification is based on the following two effects;

(A) Balance of forces acting upon particles that have entered the classifying vane assembly As shown in FIG. 4, a particle in the vane assembly is subjected to a fluid resistance force R in the centripetal direction and a centrifugal force F due to the rotation of the vanes, and the respective forces are represented by the following formulae:

$$R = 3\pi d \mu V_1,$$

$$F = \frac{\pi}{6} d^3 (\rho_1 - \rho_2) \frac{V_2^2}{r}$$

d: particle diameter [cm]

$\mu$: viscosity of gas [poise]

$V_1$: gas velocity in the centripetal direction [cm/s]

$V_2$: circumferential velocity of the vanes [cm/s]

$\rho_1$, $\rho_2$ density of particle, gas [g/cm$^2$]

And when the classifier is being operated under a fixed condition, coarse particles fulfilling the relation of $F>R$ are released to the outside of the classifier, whereas fine particles fulfilling the relation of $F<R$ flow to the inside of the classifier, and thus the particles are classified into fine particles and coarse particles.

(B) Reflected direction $\alpha$ of particles after collision against the vanes

In FIG. 4 also shows the state of a particle colliding against a vane. When the reflected direction $\alpha$ of the particle after collision against the vane is directed to the outside with respect to a tangential line, the particle is liable to be released to the outside of the classifier. On the contrary, when the reflected direction $\alpha$ is directed to the inside, the particle is liable to flow into the classifier. When air enters between the classifying vanes, turbulent flow is generated. Further, it is known that fine particles would fly in a pattern close to a turbulent flow, while coarse particles would fly in a pattern close to a linear flow as deviated from the turbulent flow. Consequently, fine particles are liable to be reflected to the inside after collision against the vane, while coarse particles are liable to be reflected to the outside, and so classification into fine particles and coarse particles can be accordingly, carried out effectively.

Figure 5:
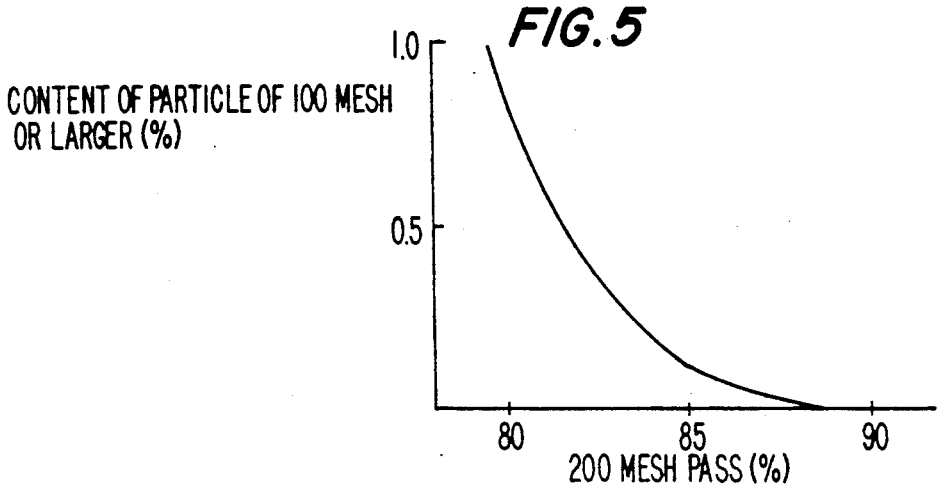
FIG. 5 is a diagram showing a characteristic of a vertical type coal grinder containing a rotary type classifier therein.

FIG. 5 is a diagram showing test results of the performance of the illustrated coal grinder. As shown in this figure, in the case where coal was ground by this grinder under a condition of 200 mesh pass 85%, coarse particles of 100 mesh or larger in the pulverized coal were only 0.1%. Furthermore, it was confirmed that this coal grinder could be operated at an extremely high degree of pulverization of 200 mesh pass 90% or more. In such a case, the amount of coarse particles of 100 mesh or larger contained in the pulverized coal was 0%.

Figure 16:
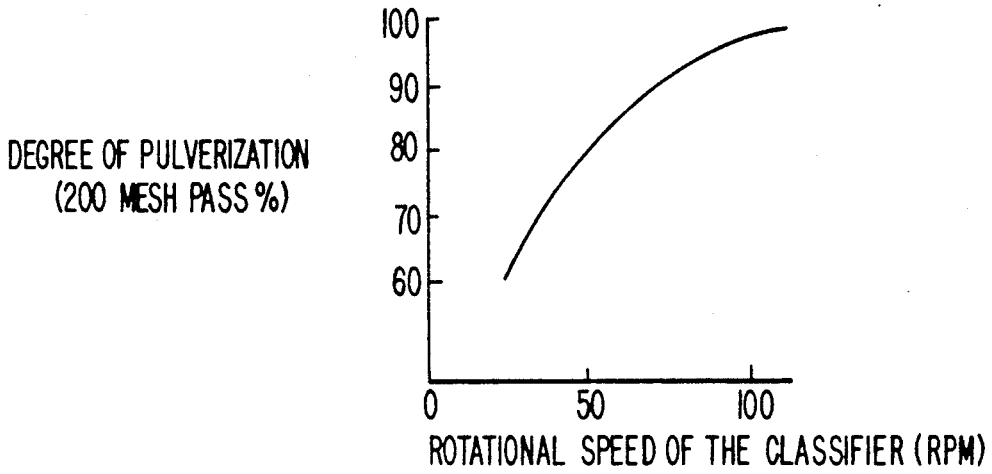
FIG. 16 is a diagram showing the variation of a degree of pulverization as a rotational speed of the classifier of FIGS. 2-4 is varied.

FIG. 16 is a diagram showing the variation of a degree of pulverization as the rotational speed of the classifier is varied. As shown in this figure, by varying the rotational speed of the classifier, a degree of pulverization can be regulated easily over a wide range.

Figure 6:
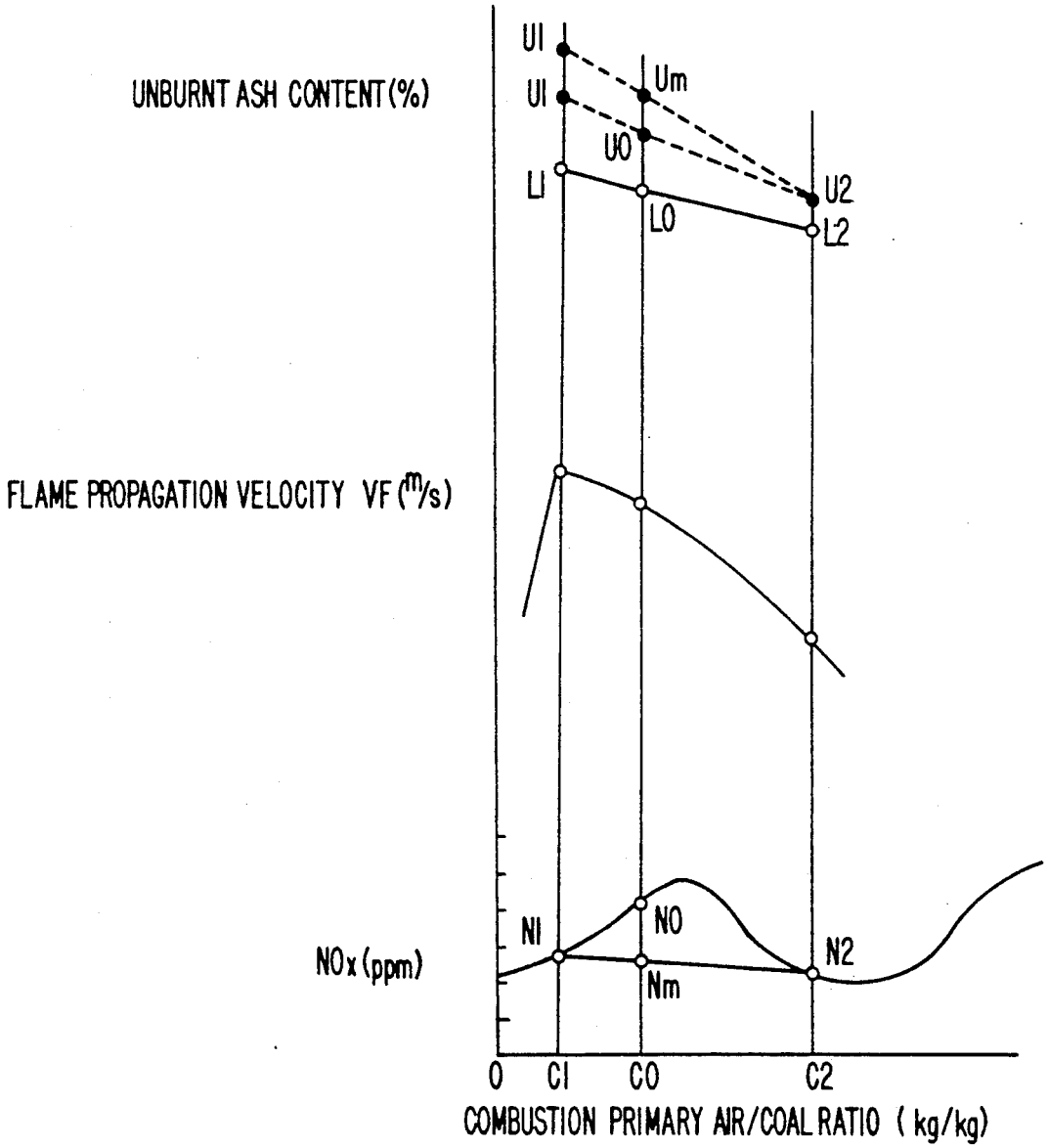
FIG. 6 is a diagram showing the relations that are established between a (combustion primary air/coal) ratio and an $NO_x$ content, a flame propagation speed and an unburnt ash content when the pulverized coal combustion method according to the aforementioned preferred embodiment is carried out.

FIG. 6 is a diagram showing relations between a (combustion primary air/coal) ratio and an $NO_x$ content, a flame propagation velocity and an unburnt ash content in the pulverized coal combustion method according to the illustrated embodiment. As shown in this figure, by burning a mixture gas flow having a (combustion primary air/coal) ratio $C_0$ after separating it into thick and thin mixture gas flows having a concentration $C_1$ (producing a thick mixture gas flame having a high coal concentration) and a concentration $C_2$ (producing a thin mixture gas flame having a low coal concentration), an $NO_x$ concentration as a whole of the burner would become a weighted mean $N_m$ of respective $NO_x$ concentrations $N_1$ and $N_2$, and it would become lower than an $NO_x$ concentration $N_0$ when a mixture gas having a single concentration $C_0$ is burnt.

On the other hand, the ignition that commences pulverized coal combustion becomes more stable as a difference between a flame propagation velocity $V_f$ of pulverized coal mixture gas and an injection flow velocity $V_a$ from a burner portion of pulverized coal mixture gas, that is, $V_f-V_a$, increases. Since the above-mentioned thick mixture gas flame has a large flame propagation velocity $V_f$ as compared to that of a mixture gas having a single concentration $C_0$, $V_f-V_1$ is comparatively large, and so the, stability of ignition is excellent.

In FIG. 6, an unburnt ash content characteristic when the pulverized coal combustion method according to this preferred embodiment is carried out can be compared to that when the method in the prior art is carried out. If degrees of pulverization within mixture gases having concentrations $C_1$ and $C_2$, respectively, are quite the same, unburnt ash contents produced from a thick mixture gas flame and a thin mixture gas flame in the case of the method in the prior art would be $U_1$ and $U_2$, respectively, and the total unburnt ash content would be $U_0$. However, due to the above-described distributor characteristics, in the case where combustion was carried out practically by employing the method in the prior art, an unburnt ash content produced from a thick mixture gas flame increased to $U_1'$, and accompanying this increase, the total unburnt ash content in the burner increased to $U_m$. On the other hand, according to this preferred embodiment, since the amount of coarse particles of 100 mesh or larger contained in the pulverized coal mixture gas having a concentration $C_1$ is much smaller, and since even operation under a condition of 200 mesh pass 85% can be performed, unburnt ash produced from a thick mixture gas flame and a thin mixture gas flame can be reduced to content levels $L_1$ and $L_2$, respectively, and so, the total unburnt ash content produced can be reduced to $L_0$.

Figure 7:
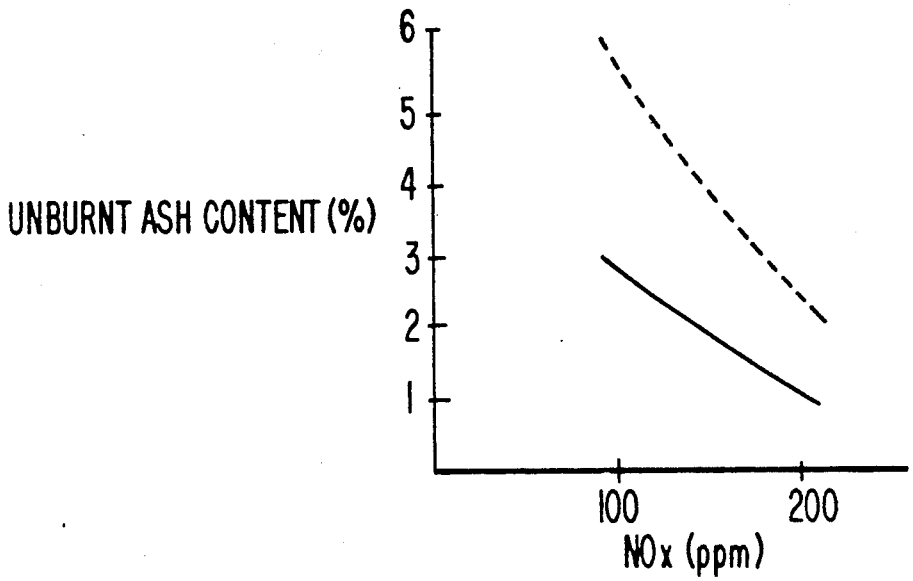
FIG. 7 is a diagram showing the relations that are established between an $NO_x$ content and an unburnt ash content, when the combustion method according to the aforementioned preferred embodiment and when the combustion method in the prior art are carried out.
Figure 8:
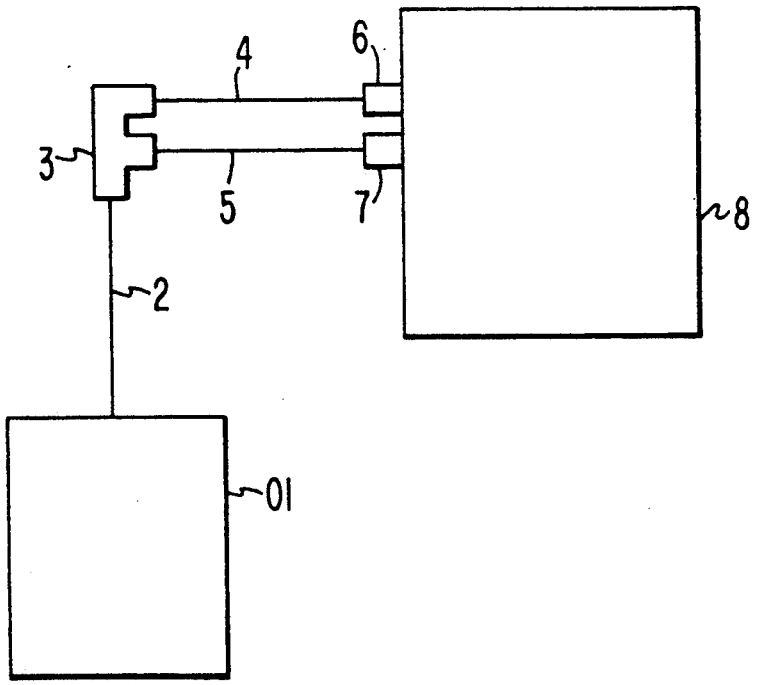
FIG. 8 (PRIOR ART)
FIG. 8 is a schematic diagram of a system for carrying out one example of a pulverized coal combustion method in the prior art.
Figure 9:
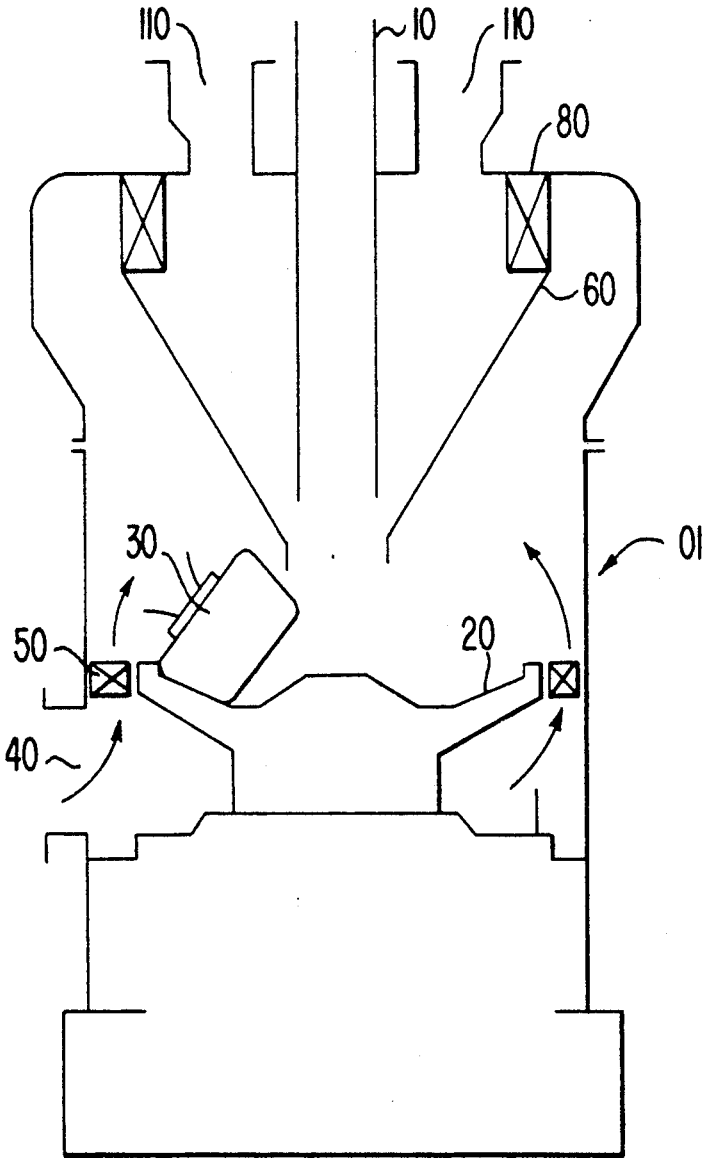
FIG. 9 (PRIOR ART)
FIG. 9 is a longitudinal cross-sectional view of a prior art vertical type coal grinder containing a stationary type classifier therein.
Figure 10:
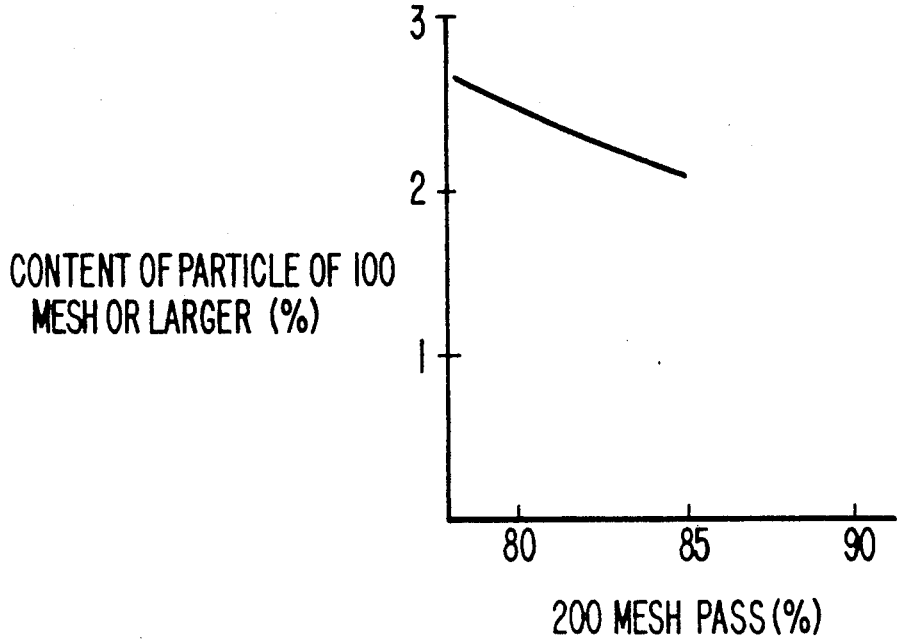
FIG. 10 is a diagram showing a characteristic of the prior art vertical type coal grinder containing a stationary type classifier therein.
Figure 11:
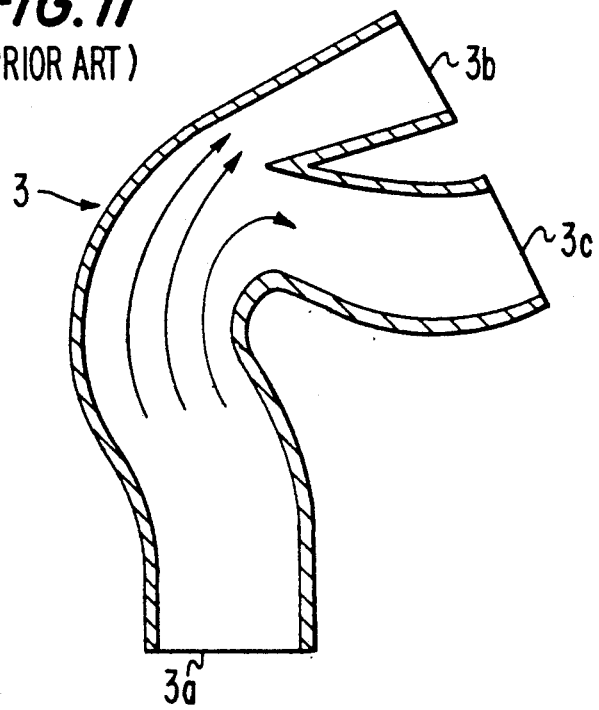
FIG. 11 (PRIOR ART)
FIG. 11 is a cross-sectional view of one example of the configuration of a distributor in the prior art system of FIG. 8.
Figure 12:
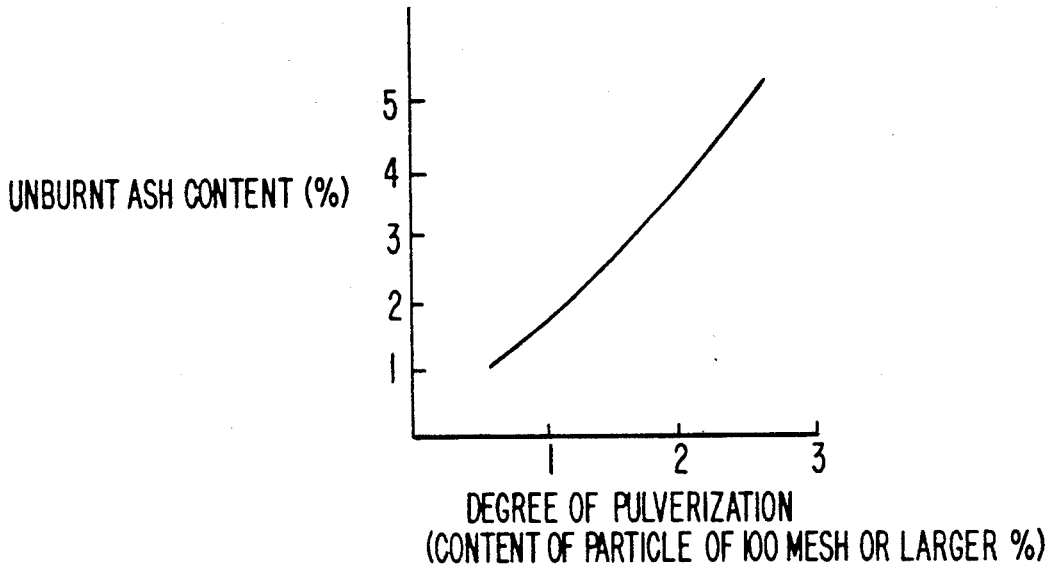
FIG. 12 is a diagram showing a general relation between a degree of pulverization and an unburnt ash content.
Figure 13:
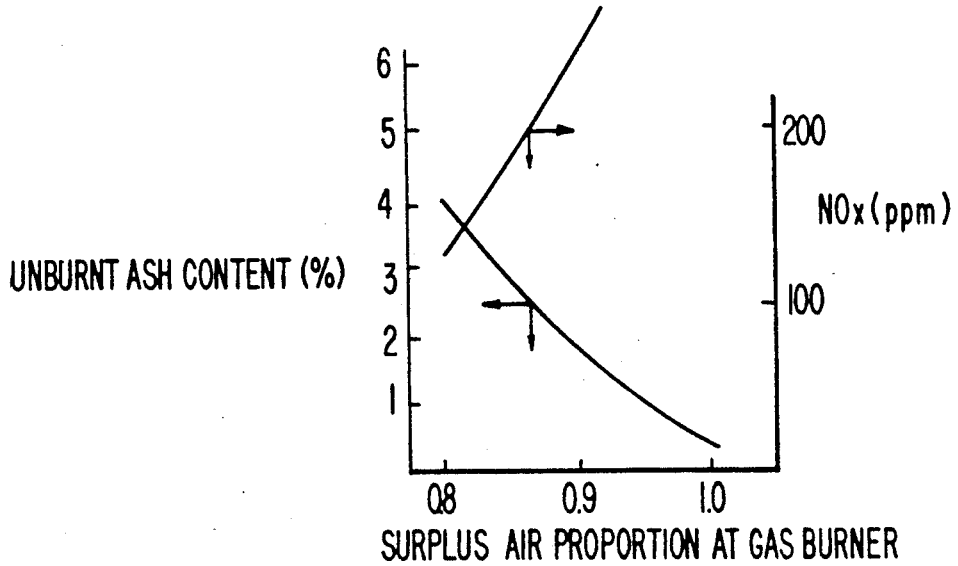
FIG. 13 is a diagram showing the relations that are established between a surplus air proportion, and an $NO_x$ content and an unburnt ash content when the combustion method in the prior art is carried out.
Figure 14:
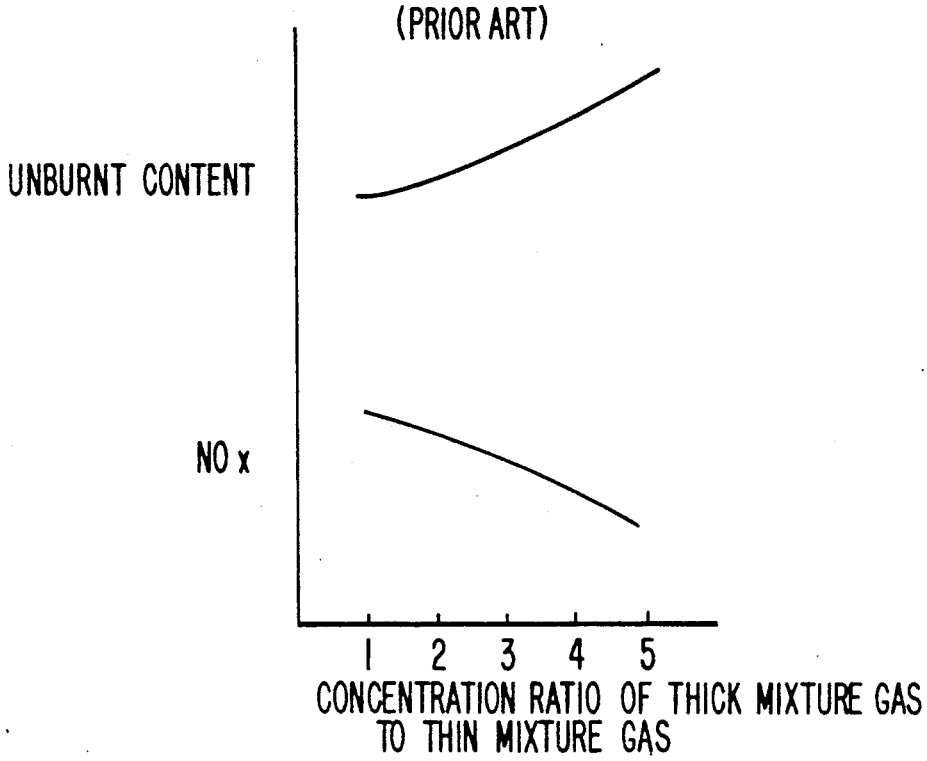
FIG. 14 (PRIOR ART)
FIG. 14 is a diagram showing the relations that are established between various concentration ratios of thick mixture gas to thin mixture gas, and an $NO_x$ content and an unburnt ash content when the combustion method in the prior art is carried out.
Figure 15:
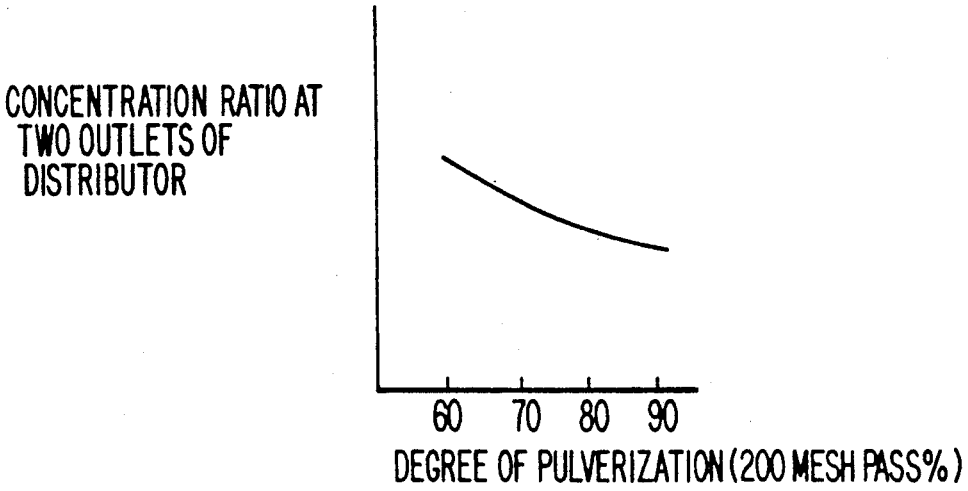
FIG. 15 is a diagram showing the relation that is established between a degree of pulverization of pulverized coal at the inlet of the distributor and a concentration ratio of thick mixture gas to thin mixture gas at its two outlets when the method according to the present invention is carried out by the apparatus of FIGS. 1-4.

FIG. 7 is a diagram showing the relations that are established between an $NO_x$ content and an unburnt ash content, when the combustion method according to this preferred embodiment and when the combustion method in the prior art are carried out. In this figure, a dash line curve indicates pulverized coal combustion characteristics of the method in the prior art, while a solid line curve indicates that of the method according to this preferred embodiment. It is seen from this figure that by employing the pulverized coal combustion method according to this preferred embodiment, an unburnt ash content with respect to a same $NO_x$ content value is reduced to one half as compared to the method in the prior art.

Figure 18:
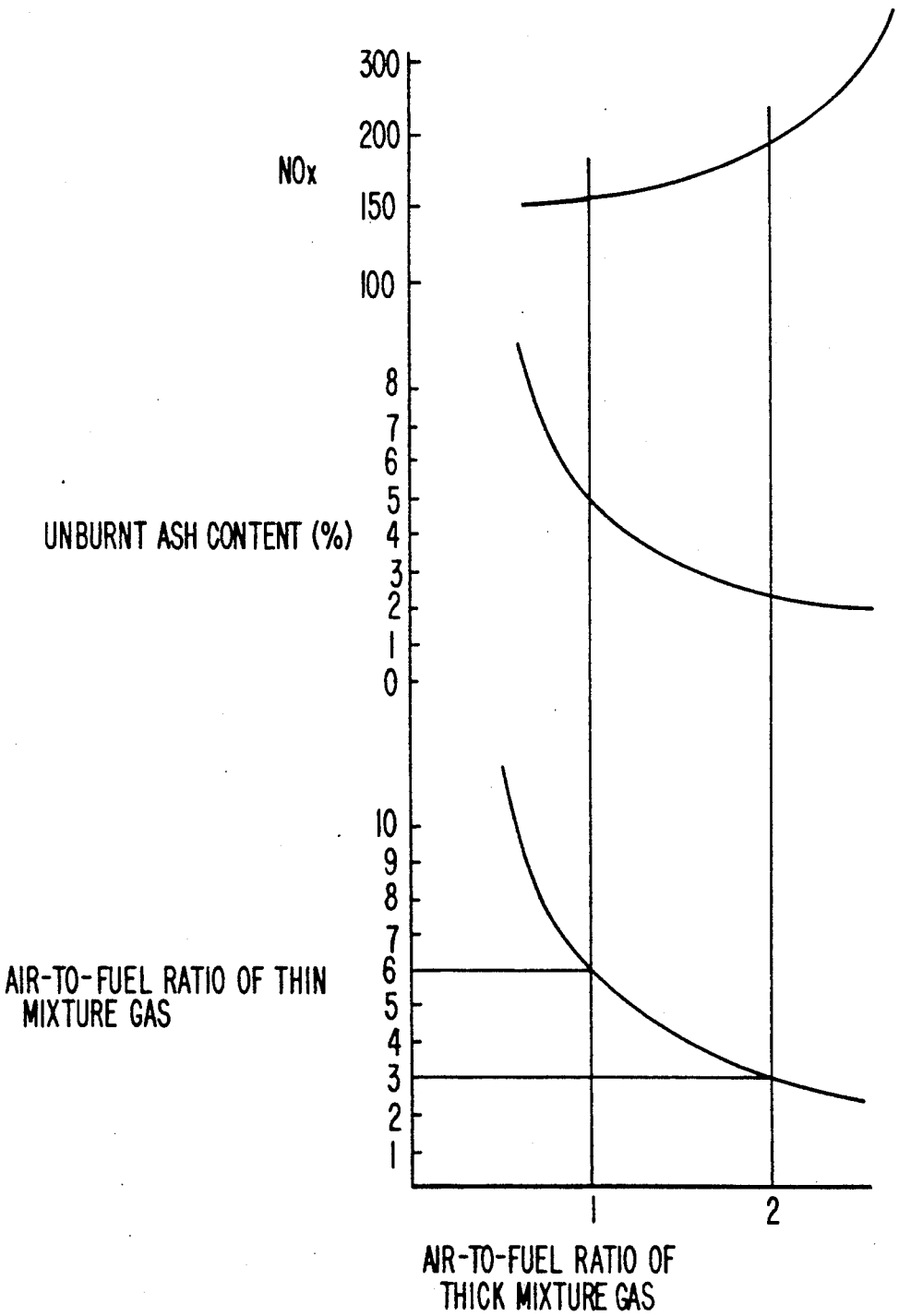
FIG. 18 is a diagram showing the relations that are established between an air-to-fuel ratio of thick mixture gas, and an $NO_x$ content, an unburnt ash content and an air-to-fuel ratio of thin mixture gas when the method according to the present invention is carried out.

In FIG. 18 are shown relations between an air-to-fuel ratio of thick mixture gas and an unburnt ash content. From this figure, it is seen that in the case where an air-to-fuel ratio of thick mixture gas is smaller than 1, an unburnt ash content increases abruptly, and that in the case where the same air-to-fuel ratio is 2 or larger, an $NO_x$ content increases abruptly. Accordingly, it is preferable to regulate an air-to-fuel ratio of thick mixture gas to within the range of 1–2. At this time, an air-to-fuel ratio of thin mixture gas is about 3–6.

Figure 19:
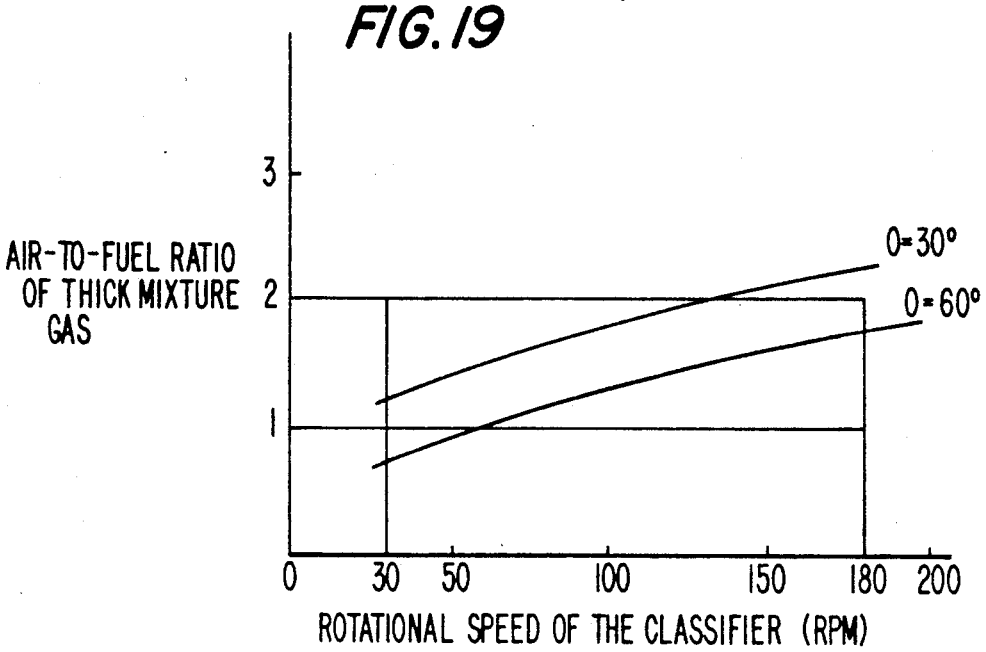
FIG. 19 is a diagram showing a relation between a rotational speed of the classifier of FIGS. 2-4 and an air-to-fuel ratio of thick mixture gas.
Figure 20:
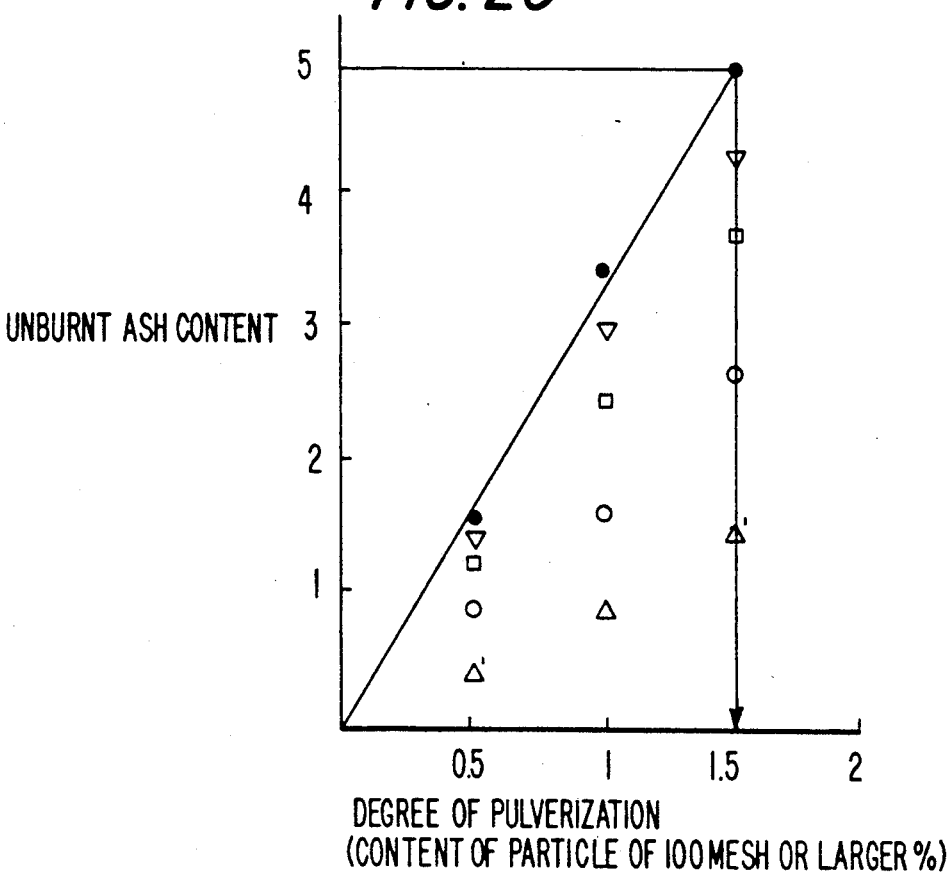
FIG. 20 is a diagram showing a relation between a degree of pulverization of coal and an unburnt ash content in a quantity of the burnt pulverized coal.

Characteristics of a rotary type classifier in which an air-to-fuel ratio of thick mixture gas can be chosen in the range of 1–2, can be exemplified as follows. That is, FIG. 19 shows the mode of variation of an air-to-fuel ratio of thick mixture when a rotational speed of a classifier is varied. From this figure, it is seen that by varying a rotational speed of a classifier in the range of 30–180 rpm and varying the angles $\theta$ (See FIG. 4) formed between the classifying vanes and the direction of rotation in the range of 30°–60°, an air-to-fuel ratio of thick mixture gas can be regulated in the range of 1–2. At this time, an air-to-fuel ratio of thin mixture gas becomes about 3–6 as shown in FIG. 18.

Figure 17:
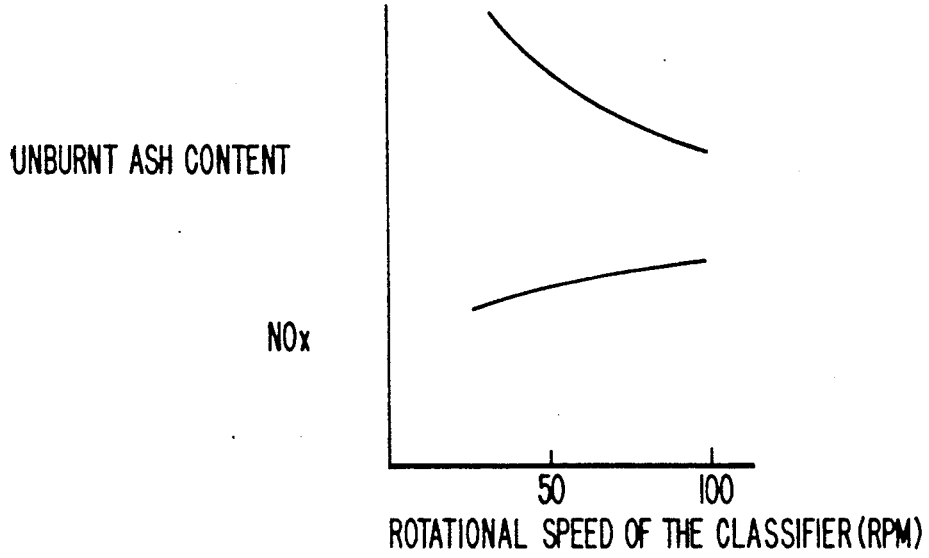
FIG. 17 is a diagram showing relations between a rotational speed of the classifier of FIGS. 2-4, and an $NO_x$ content and an unburnt ash content.

By regulating a rotational speed of a classifier as shown in FIG. 17 on the basis of the relations shown in FIGS. 18 and 19, it has become possible to automatically control an $NO_x$ content and an unburnt ash content.

As described in detail above, by employing the pulverized coal combustion method according to the present invention, an unburnt ash content as well as a concentration of nitrogen oxides in an exhaust gas can be remarkably reduced, and also, ideal pulverized coal combustion having an excellent ignition stability can be realized.

While a principle of the present invention has been disclosed above in connection with one preferred embodiment of the invention, it is a matter of course that all matter contained in the above description and illustrated in the accompanying drawings shall be interpreted to be illustrative and not as limitative of the scope of the present invention.

What is claimed is:

1. A method of combusting coal comprising:

pulverizing a quantity of coal;

blowing the pulverized coal into a rotary classifier having a plurality of blade-like classifying vanes spaced from one another about a rotational axis of the classifier, and drive shift means for rotating the vanes about said rotational axis;

operating the rotary classifier in a manner which separates from the pulverized coal a portion thereof which has a degree of pulverization of 100 mesh residue 1.5% or less;

introducing only said portion of the pulverized coal into a distributor that separates said portion of the pulverized coal and said gas into a thin mixture gas, comprising gas and particles of coal, and a thick mixture gas comprising gas and particles of coal that are larger than those of the thin mixture gas;

injecting the thin mixture gas and the thick mixture gas through respective burner injection ports and into a common furnace at air-to-fuel ratios within ranges of 3–6 and 1–2, respectively, to ignite the mixture gases and thereby combust the coal particles thereof.

2. A method of combusting coal as claimed in claim 1, wherein the step of operating the rotary classifier includes controlling the speed of rotation of the classifying vanes such that the portion of coal which has a degree of pulverization of 100 mesh residue 1.5% or less is separated from the remaining portion of the pulverized coal.

3. A method of combusting coal as claimed in claim 1, wherein the step of operating the rotary classifier includes preadjusting the inclination of the classifying vanes relative to the direction of rotation of the vanes.

4. A method of combusting coal as claimed in claim 1, wherein the step of operating the rotary classifier includes regulating the speed of rotation of the classifying vanes to within the range of 30–180 rpm, and preadjusting the inclination of the classifying vanes relative to the direction of rotation of the vanes to establish respective angles therebetween within the range of 30°–60°, whereby said rotary classifier effects said air-to-fuel ratios.

5. A method of combusting coal comprising:

pulverizing a quantity of coal;

blowing the pulverized coal into a rotary classifier having a plurality of blade-like classifying vanes spaced from one another about a rotational axis of the classifier, and drive shift means for rotating the vanes about said rotational axis;

operating the rotary classifier in a manner which separates from the pulverized coal a portion thereof which has a desired degree of pulverization;

introducing only said portion of the pulverized coal into a distributor that separates said portion of the pulverized coal and said gas into thin mixture gas, comprising gas and particles of coal, and a thick mixture gas comprising gas and particles of coal that are larger than those of the thin mixture gas; and injecting the thin mixture gas and the thick mixture gas through respective burner injection ports and into a common furnace to ignite the mixture gases and thereby combust the coal particles thereof.

* * * * *